US008850982B2

(12) United States Patent
Rancourt et al.

(10) Patent No.: US 8,850,982 B2
(45) Date of Patent: Oct. 7, 2014

(54) METHOD OF PHASING AND ACCELERATING CYLINDERS OF PRINTING PRESS DURING AUTO TRANSFER

(75) Inventors: Michael Raymond Rancourt, Merrimack, NH (US); Atef Tanious Massoud, Nothingham, NH (US); George Athans, Lee, NH (US); Richard Conrad, Barrington, NH (US)

(73) Assignee: Goss International Americas, Inc., Durham, NC (US)

( * ) Notice: Subject to any disclaimer, the term of this patent is extended or adjusted under 35 U.S.C. 154(b) by 1134 days.

(21) Appl. No.: 12/563,747

(22) Filed: Sep. 21, 2009

(65) Prior Publication Data

US 2011/0067588 A1 Mar. 24, 2011

(51) Int. Cl.

| | |
|---|---|
| ***B41L 3/02*** | (2006.01) |
| ***B41F 13/24*** | (2006.01) |
| ***B41F 13/12*** | (2006.01) |
| ***B41F 33/08*** | (2006.01) |

(52) U.S. Cl.

CPC ..... *B41F 13/24* (2013.01); *B41F 13/12* (2013.01); *B41F 33/08* (2013.01)

USPC ..... 101/486; 101/180; 101/181; 101/247; 101/248; 101/483

(58) Field of Classification Search

USPC ..... 101/170, 180, 181, 182, 247, 248, 483, 101/485, 486

See application file for complete search history.

(56) References Cited

U.S. PATENT DOCUMENTS

| | | | | |
|---|---|---|---|---|
| 4,108,067 | A * | 8/1978 | Werner | 101/224 |
| 6,019,039 | A * | 2/2000 | Knauer et al. | 101/218 |
| 6,327,975 | B1 | 12/2001 | Izawa | 101/170 |
| 8,122,826 | B2 * | 2/2012 | Richards | 101/221 |
| 8,141,489 | B2 * | 3/2012 | Belanger et al. | 101/485 |
| 2006/0249044 | A1 | 11/2006 | Hammond et al. | 101/486 |
| 2007/0144370 | A1 | 6/2007 | Menu et al. | |
| 2008/0190309 | A1 * | 8/2008 | Rancourt et al. | 101/228 |

* cited by examiner

*Primary Examiner* — Ren Yan

(74) *Attorney, Agent, or Firm* — Davidson, Davidson & Kappel, LLC

(57) ABSTRACT

A method of preparing cylinders for printing on a web during auto transfer operations is provided. The method includes the steps of printing images on a web with at least one first printing cylinder; accelerating at least one second printing cylinder so that the at least one second printing cylinder has a surface velocity that equals a velocity of the web; adjusting a phasing of the at least one second printing cylinder with respect to the web during the accelerating step and before the surface velocity of the at least one second printing cylinder equals the velocity of the web; moving the at least one first printing cylinder away from the web and moving the at least one second printing cylinder towards the web; and printing images on the web with the at least one second printing cylinder. A printing press configured for auto transfer is also provided.

8 Claims, 3 Drawing Sheets

METHOD OF PHASING AND ACCELERATING CYLINDERS OF PRINTING PRESS DURING AUTO TRANSFER

The present invention relates generally to printing presses and more specifically to a method of phasing and accelerating cylinders of a printing press during auto transfer.

BACKGROUND OF INVENTION

In offset printing presses one or more printing units may be moved out of contact with, or thrown off of, a passing web as one or more additional printing units are moved into contact with, or thrown onto, the web for continuous printing. This operation, which may be referred to as auto transfer, may help minimize the time between printing job changes and may reduce paper waste.

U.S. Publication No. 2007/0144370, which is hereby incorporated by reference herein, describes auto transfer.

BRIEF SUMMARY OF THE INVENTION

A method of preparing cylinders for printing on a web during auto transfer operations is provided. The method includes the steps of printing images on a web with at least one first printing cylinder; accelerating at least one second printing cylinder so that the at least one second printing cylinder has a surface velocity that equals a velocity of the web; adjusting a phasing of the at least one second printing cylinder with respect to the web during the accelerating step and before the surface velocity of the at least one second printing cylinder equals the velocity of the web; moving the at least one first printing cylinder away from the web and moving the at least one second printing cylinder towards the web; and printing images on the web with the at least one second printing cylinder.

A printing press configured for auto transfer is also provided. The printing press includes at least one first printing cylinder for printing images on a web, at least one second printing cylinder for printing images on the web and a controller coupled to the at least one first printing cylinder and the at least one second printing cylinder. The controller is capable of rotating the at least one first printing cylinder and the at least one second printing cylinder during auto transfer. The controller simultaneously accelerating and phasing the at least one second printing cylinder before a surface velocity of the at least one second printing cylinder equals a velocity of the web as the at least one first printing cylinder print images on the web.

BRIEF DESCRIPTION OF THE DRAWINGS

The present invention is described below by reference to the following drawings, in which.

DETAILED DESCRIPTION

In order for the printing units that are thrown onto the web to be able to properly print on the web, cylinders of each printing unit may need to be properly accelerated and phased such that the cylinders have a surface velocity that matches the velocity of the web when the cylinders begin printing.

Figure 1:
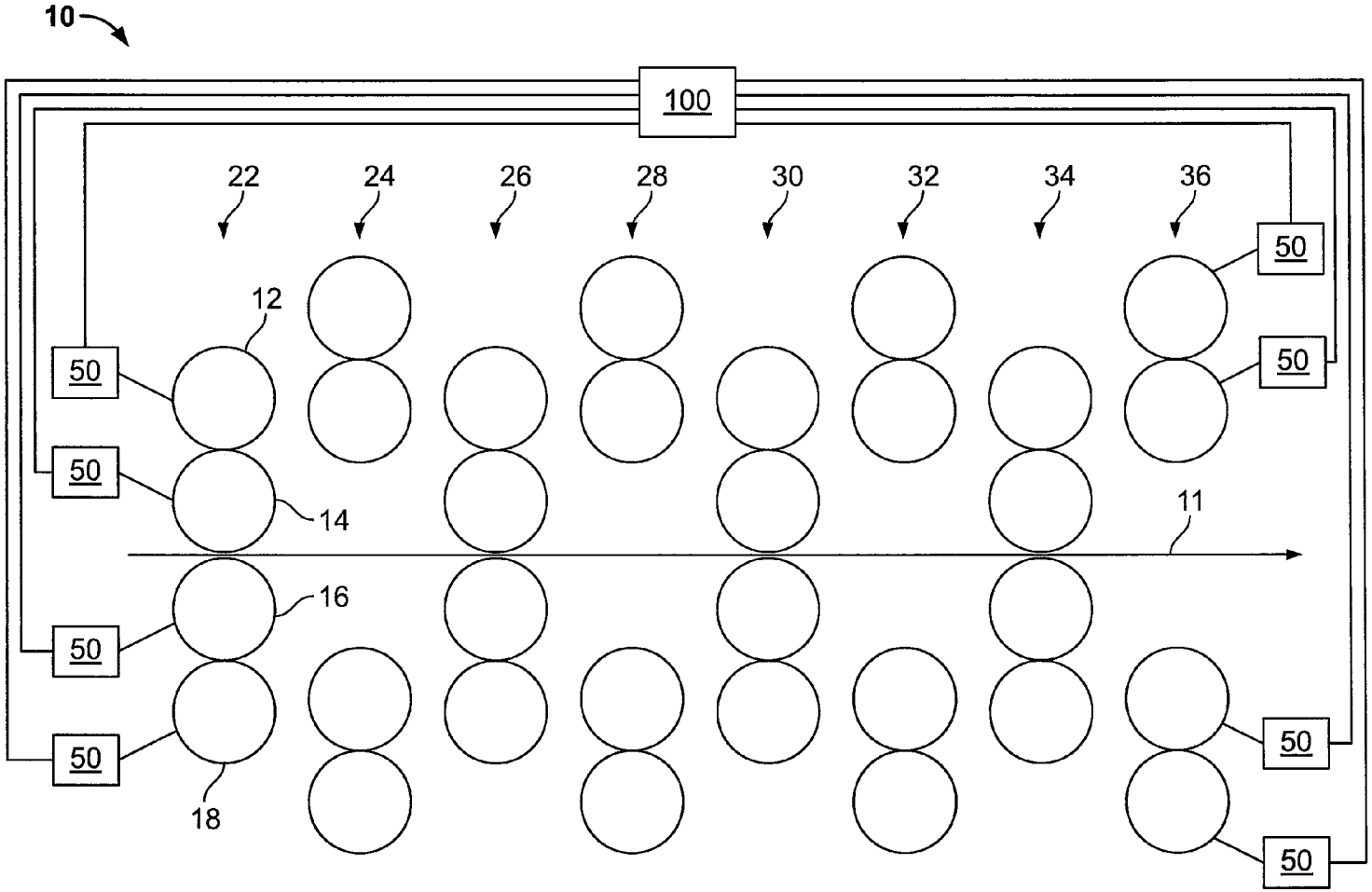
FIG. 1 shows a schematic view of a printing press according to an embodiment of the present invention with a first group of printing units printing on a web and a second group of printing units thrown off of the web.

FIG. 1 shows a schematic view of a printing press 10 including printing units 22, 24, 26, 28, 30, 32, 34, 36. Each printing unit 22, 24, 26, 28, 30, 32, 34, 36 includes an upper plate cylinder 12, an upper blanket cylinder 14, a lower blanket cylinder 16 and a lower plate cylinder 18. Printing press 10 may also include a dryer, a folder having a former for folding a web, cutting cylinders and folding cylinders.

In FIG. 1, printing units 22, 26, 30, 34 are on impression and printing four color images of a first print job on a web 11. In operation, an inking and dampening apparatuses provide ink and dampening solution to plate cylinders 12, 18 of each printing unit 22, 26, 30, 34. Plate cylinders 12, 18 of each printing unit 22, 26, 30, 34, which may be provided with imaged printing plates mounted thereon, transfer inked images to printing blankets on respective blanket cylinders 14, 16 of each printing unit 22, 26, 30, 34. Blanket cylinders 14, 16 of each printing unit 22, 26, 30, 34 then transfer the images to web 11 passing between blanket cylinders 14, 16 of each printing unit 22, 26, 30, 34.

Printing units 24, 28, 32, 36 are in an off impression position with plate cylinders 12, 18 of printing units 24, 28, 32, 36 including plates carrying image information for a second print job. In a preferred embodiment, each printing cylinder 12, 14, 16, 18 of printing units 22, 24, 26, 28, 30, 32, 34, 36 may be coupled to a respective individual motor 50. For clarity, in FIG. 1, motors 50 are shown only for printing units 22, 36. A controller 100 controls the rotation cylinders 12, 14, 16, 18 of printing units 22, 24, 26, 28, 30, 32, 34, 36 via motors 50. Controller 100 may also control movement of cylinders 12, 14, 16, 18 of printing units 22, 24, 26, 28, 30, 32, 34, 36 toward and away from web 11. Printing units 22, 24, 26, 28, 30, 32, 34, 36 may be thrown on and off of web 11 by respective throw off mechanisms. Each throw off mechanism may be for example the supporting mechanism disclosed in incorporated by reference U.S. Publication No. 2007/0144370.

Figure 2:
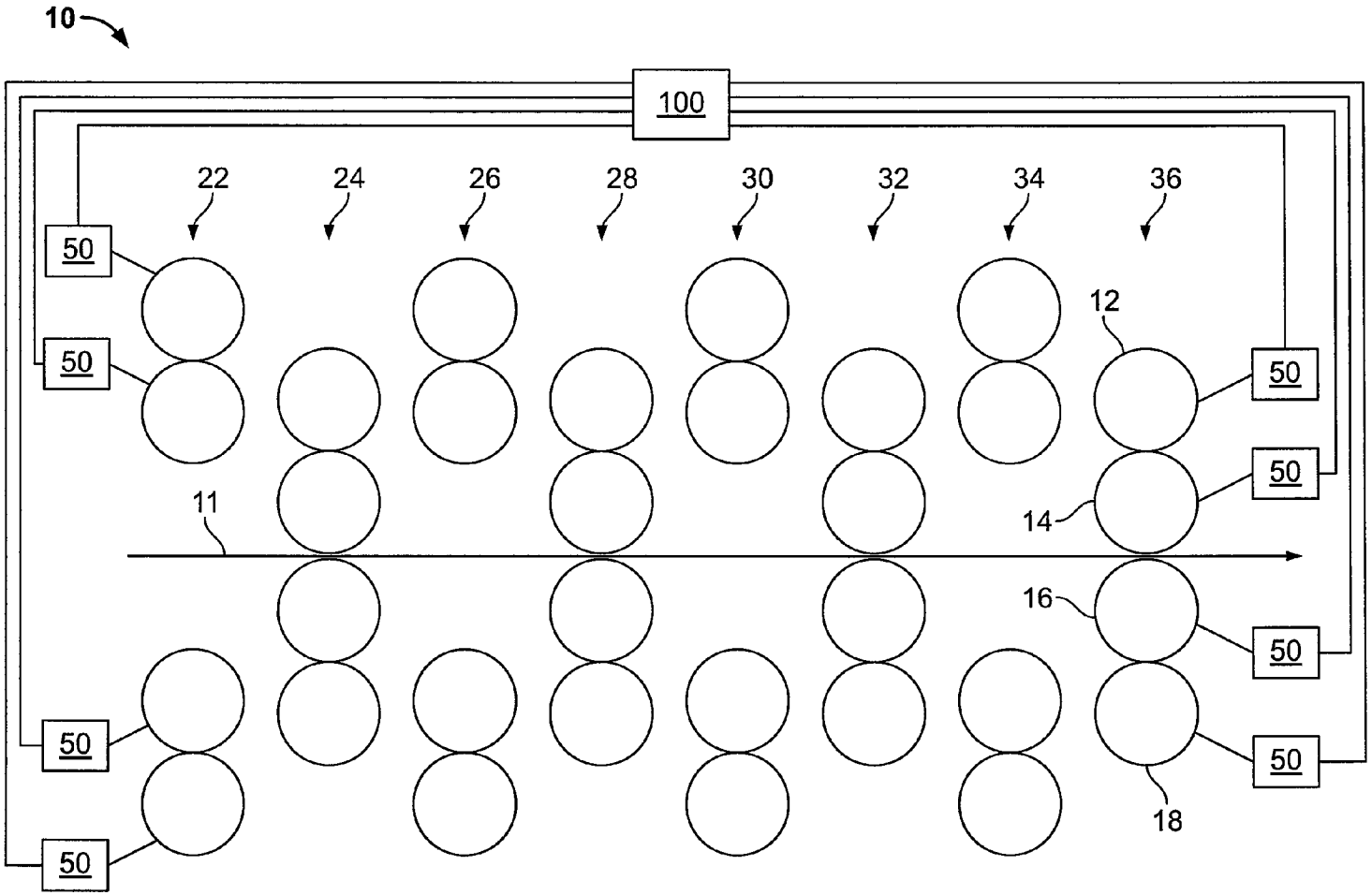
FIG. 2 shows a schematic view of the printing press shown in FIG. 1 with the second group of printing units printing on the web and the first group of printing units thrown off of the web.

FIG. 2 shows printing press 10 shown in FIG. 1 printing the second print job. Printing units 24, 28, 32, 36 are on impression printing four color images of the second print job on web 11 in the same manner that printing units 22, 26, 30, 34 printed the four color images of the first print job on web 11. Motors 50 are rotating respective cylinders 12, 14, 16, 18 of printing units 24, 28, 32, 36. For clarity, in FIG. 2, motors 50 are shown only for printing units 22, 36, but a motor may be provided for each cylinder 12, 14, 16, 18 of each printing unit 24, 28, 32, 36. Printing units 22, 26, 30, 34 are now in an off impression position and not printing on web 11. Plate cylinders 12, 18 of printing units 22, 26, 30, 34 may be undergoing automatic plate changing operations in order to print a third print job after printing units 24, 28, 32, 36 complete the second print job. For clarity, in FIG. 2, motors 50 are shown only for printing units 22, 36.

In order to throw one of printing units 24, 28, 32, 36, for example printing unit 24, on impression, from the off impression position, controller 100 signals motors 50 to rotate respective cylinders 12, 14, 16, 18 so that when cylinders 14, 16 contact web 11 and printing unit 24 begins printing images on web 11, cylinders 12, 14, 16, 18 are traveling at a surface velocity that equals the velocity of web 11 and are appropriately phased to print images in a proper alignment on web 11. In this embodiment, cylinders 12, 14, 16, 18 of printing units 24, 28, 32, 36 are thrown on impression simultaneously.

In other embodiments of the present invention, instead of moving both plate cylinders 12, 18 and blanket cylinders 14, 16 of printing units 22, 24, 26, 28, 30, 32, 34, 36 away from web 11 during throw off and toward web 11 for printing, plate cylinders 12, 18 of printing units 22, 24, 26, 28, 30, 32, 34, 36 may remain stationary and only blanket cylinders 14, 16 of printing units 22, 24, 26, 28, 30, 32, 34, 36 are moved in relation to web 11. This may be accomplished by swinging blanket cylinders 14, 16 of printing units 22, 24, 26, 28, 30, 32, 34, 36 toward and away from web 11. Thus, plate cylinders 12, 18 of printing units 22, 24, 26, 28, 30, 32, 34, 36 may not need to moved for printing units 22, 24, 26, 28, 30, 32, 34, 36 to moved from an off impression position to an on impression position or from an on impression position to an off impression position.

Figure 3A:
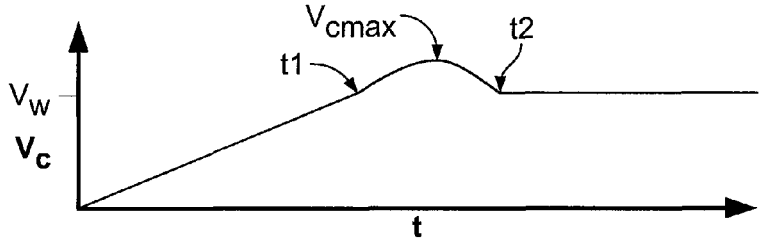
FIG. 3a (Prior Art)
FIGS. 3*a* and 3*b* show graphs illustrating the rotation of a plate cylinder and a blanket cylinder of a printing unit as the printing unit is prepared to go on impression and as the printing unit is on impression according to a known method.
Figure 3B:
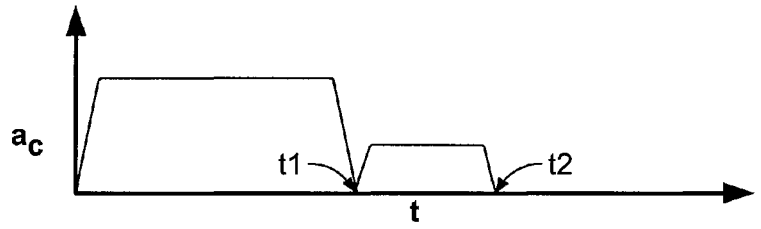
FIG. 3b (Prior Art)

FIGS. 3*a* and 3*b* show graphs illustrating the rotation of a plate cylinder and a blanket cylinder of a printing unit as the printing unit is prepared to go on impression and as the print on a web according to a known method. The plate cylinder and the blanket cylinder are rotated so both cylinders have a surface velocity $v_c$. FIG. 3*a* shows a graph of the surface velocity $v_c$ of the plate and blanket cylinders versus time. FIG. 3*b* shows a graph of the acceleration $a_c$ of the plate and blanket cylinders versus time.

In this known method, before the printing unit is moved into an on impression position to print on the web, the plate and blanket cylinders are accelerated until time t1, when the surface velocity $v_c$ of the plate and blanket cylinders equals the velocity $v_w$ of the web. Then, the plate and blanket cylinders are further accelerated to a maximum surface velocity $v_{cmax}$ and then decelerated back down to the velocity $v_w$ of the web so the plate and blanket cylinders are appropriately phased to print images on the web. At time t2, when the surface velocity $v_c$ of the plate and blanket cylinders equals the velocity $v_w$ of the web and the plate and blanket cylinders are appropriately phased, the printing unit is moved on impression and begins printing on the web. As printing unit is moved on impression, a second printing unit including a second pair of plate and blanket cylinders, which just finished printing on the web, is moved off impression. At time t2, when the printing unit is moved on impression and the second printing unit is moved off impression, the plate and blanket cylinders and the second pair of plate and blanket cylinders have the same phasing with respect to the web. As a result, the printing unit going on impression prints images on the web in locations corresponding to locations where the second pair of plate and blanket cylinders were phased to print images on the web.

Because the plate and blanket cylinder are phased after the plate and blanket cylinder are accelerated to have a surface velocity $v_c$ that equals the velocity $v_w$ of the web, the plate and blanket cylinders are accelerated to the maximum velocity $v_{cmax}$ just before the printing unit goes on impression. Driving the blanket cylinder to the maximum velocity $v_{cmax}$ may cause the blanket cylinder to push air towards the web, resulting in web flutter. This web flutter may be quite dramatic and may cause the web to break.

Figure 4A:
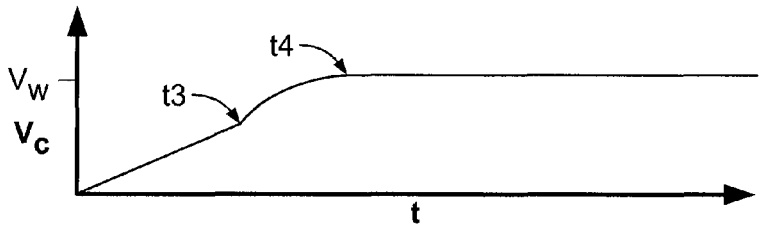
FIGS. 4*a* and 4*b* show graphs illustrating the rotation of a plate cylinder and a blanket cylinder of a printing unit as the printing unit is being prepared to go on impression and as the printing unit moves on impression to print according to an embodiment of the present invention.
Figure 4B:
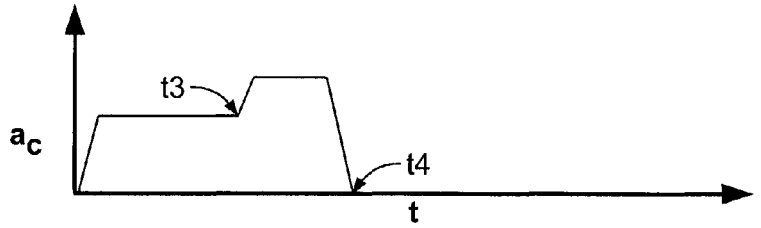

FIGS. 4*a* and 4*b* show graphs illustrating the rotation of a plate cylinder and a blanket cylinder of a printing unit as the printing unit is being prepared to go on impression and as the printing unit goes on impression and begins to print according to an embodiment of the present invention. FIG. 4*a* shows a graph of the surface velocity $v_c$ of the plate and blanket cylinders versus time. FIG. 4*b* shows a graph of the acceleration $a_c$ of the plate and blanket cylinders versus time.

In this embodiment, instead of accelerating the plate and blanket cylinders to match the velocity $v_w$ of the web and then phasing the plate and blanket cylinders by accelerating and decelerating the plate and blanket cylinders, the plate and blanket cylinders are phased as they are accelerated to match the velocity $v_w$ of the web. Thus, the cylinders are not accelerated to a surface velocity $v_c$ that is greater than the velocity $v_w$ of the web, and advantageously, the pushing of air by the blanket cylinder just before the printing unit goes on impression may be reduced or eliminated and the associated web flutter may be reduced or eliminated.

As shown in FIGS. 4*a* and 4*b*, the place and blanket cylinders are accelerated until a time t3, when the plate and blanket cylinders are both phased and accelerated simultaneously. The plate and blanket cylinders are phased and accelerated until a time t4 when the plate and blanket cylinders are appropriately phased to print on the web and also have a surface velocity $v_c$ that equals the velocity $v_w$ of the web. At time t4, the printing unit is moved on impression and begins printing on the web. As the printing unit is moved to the on impression position, a second printing unit including a second pair of plate and blanket cylinders, which just finished printing on the web, is moved off impression. At time t4, when the printing unit is moved on impression and the second printing unit is moved off impression, the plate and blanket cylinders and the second pair of plate and blanket cylinders have the same phasing with respect to the web.

Figure 5A:
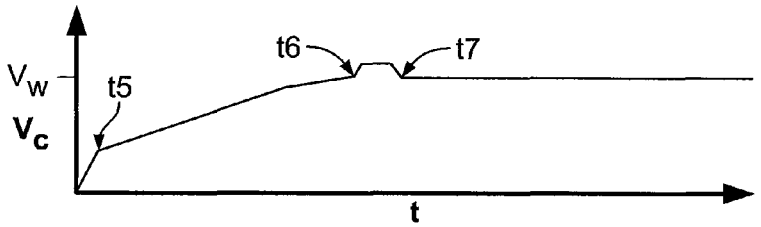
FIGS. 5*a* and 5*b* show graphs illustrating the rotation of a plate cylinder and a blanket cylinder of a printing unit as the printing unit is being prepared to go on impression and as the printing unit moves on impression to print according to another embodiment of the present invention.
Figure 5B:
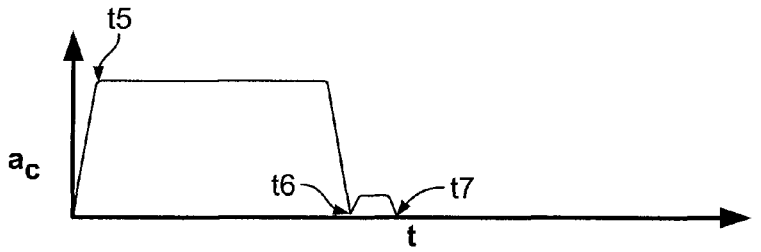

FIGS. 5*a* and 5*b* show graphs illustrating the rotation of a plate cylinder and a blanket cylinder of a printing unit as the printing unit is being prepared to go on impression and as the printing unit goes on impression and begins to print according to another embodiment of the present invention. FIG. 5*a* shows a graph of the surface velocity $v_c$ of the plate and blanket cylinders versus time. FIG. 5*b* shows a graph of the acceleration $a_c$ of the plate and blanket cylinders versus time.

In this embodiment, the plate and blanket cylinders are accelerated briefly until a time t5, when the plate and blanket cylinders are accelerated and initially phase adjusted at the same time. Then, at a time t6, when the surface velocity $v_c$ of the plate and blanket cylinders equals the velocity $v_w$ of the web, to correct a minor disparity between the phasing of the plate and blanket cylinder and the desired phasing of the plate and blanket cylinder, the plate and blanket cylinders are again phased by accelerating and then decelerating the plate and blanket cylinder by a minimal amount to appropriately phase the plate and blanket cylinders for printing on the web. At a time t7, when the plate and blanket cylinders are appropriately phased, surface velocity $v_c$ of the cylinders equals the velocity $v_w$ of the web and the printing unit is moved on impression and begins printing on the web.

As the printing unit is moved on impression, a second printing unit including a second pair of plate and blanket cylinders, which just finished printing on the web, is moved off impression. At time t7, when the printing unit is moved on impression and the second printing unit is moved off impression, the plate and blanket cylinders and the second pair of plate and blanket cylinders have the same phasing with respect to the web.

In this embodiment, the initial phasing of the plate and blanket cylinders before the surface velocity $v_c$ of the plate and blanket cylinders reaches the velocity $v_w$ of the web, helps to minimize the amount that the surface velocity $v_c$ of the plate and blanket cylinders exceeds the velocity $v_w$ of the web and minimizes the amount of acceleration necessary just before the cylinders are moved on impression. Thus, the initial phasing during acceleration of the plate and blanket cylinders may advantageously reduce or eliminate the pushing of air by the blanket cylinder just before the printing unit goes on impression and may reduce or eliminate the associated web flutter.

The accelerating and phasing method discussed in regards to FIGS. 4*a*, 4*b* and the accelerating and phasing method discussed in regards to 5*a*, 5*b* may be applied with each of the printing units 22, 24, 26, 28, 30, 32, 34, 36 shown in FIGS. 1 and 2. These methods allow printing press 10 to match the surface velocities of cylinders 12, 14, 16, 18 of printing units 22, 24, 26, 28, 30, 32, 34, 36 to a velocity of the web and match the phase relationship between plate cylinders 12, 18 of printing units 22, 24, 26, 28, 30, 32, 34, 36 as the respective printing units 22, 24, 26, 28, 30, 32, 34, 36 are moved on impression. As a result, registration reference, color bar and ribbon automated control search zones may be maintained and waste may be minimized.

Before printing units 24, 28, 32, 36 shown in FIGS. 1 and 2 are moved on impression to print the second print job, controller 100 may direct motors 50 coupled to each upper cylinder 12, 14 of each printing unit 24, 28, 32, 36 motors 50 and the lower cylinders 16, 18 of each printing unit 24, 28, 32, 36 to accelerate the printing units 24, 28, 32, 36 in accordance with the method discussed with respect to FIGS. 4*a*, 4*b* or accordance with the method discussed with respect to FIGS. 5*a*, 5*b*. Printing units 24, 28, 32, 36 are all simultaneously moved on impression to begin printing the second print job on web 11. As printing units 24, 28, 32, 36 are moved on impression, printing units 22, 26, 30, 34, which finished printing the first print job, are moved off impression.

Before printing units 24, 28, 32, 36 finish printing the second print job, and after new printing plates have been mounted on the plate cylinders 12, 18 of printing units 22, 26, 30, 34, controller 100 may direct motors 50 coupled to each upper cylinder 12, 14 of each printing unit 22, 26, 30, 34 and motors 50 coupled to each lower cylinder 16, 18 of each printing unit 22, 26, 30, 34 to accelerate the printing units 22, 26, 30, 34 in accordance with the method discussed with respect to FIGS. 4*a*, 4*b* or accordance with the method discussed with respect to FIGS. 5*a*, 5*b*. Printing units 22, 26, 30, 34 are all simultaneously moved on impression to begin printing the third print job on web 11. As printing units 22, 26, 30, 34 are moved on impression, printing units 24, 28, 32, 36, which finished printing the second print job, are moved off impression.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method of preparing cylinders for printing on a web during auto transfer operations comprising:

printing images on a web with at least one first printing cylinder;

during said step of printing images on the web with at least one first printing cylinder, accelerating at least one second printing cylinder so that the at least one second printing cylinder has a surface velocity that equals a velocity of the web;

adjusting, when the surface velocity of the at least one second printing cylinder is less than the surface velocity of the web, a phasing of the at least one second printing cylinder with respect to the web during the accelerating step and before the surface velocity of the at least one second printing cylinder equals the velocity of the web; and thereafter moving the at least one first printing cylinder away from the web and moving the at least one second printing cylinder towards the web; and printing images on the web with the at least one second printing cylinder.

2. The method recited in claim 1 wherein the step of adjusting the phasing of the at least one second printing cylinder with respect to the web includes rotating the at least one second printing cylinder so that the phasing of the at least one second printing cylinder with respect to the web corresponds to a phasing of the at least one first printing cylinder with respect to the web.

3. The method recited in claim 1 wherein a maximum surface velocity of the at least one second printing cylinder does not exceed the velocity of the web during the phasing and accelerating steps.

4. The method recited in claim 1 wherein the images printed on the web with the at least one first printing cylinder are images of a first print job and the images printed on the web with the at least one second printing cylinder are images of a second print job.

5. The method recited in claim 1 wherein the at least one first printing cylinder includes a first plate cylinder and a first blanket cylinder and the at least one second printing cylinder includes a second plate cylinder and a second blanket cylinder.

6. The method recited in claim 1 wherein the at least one first printing cylinder includes four printing units each including a first plate cylinder and a first blanket cylinder and the images printed on the web with the first printing cylinders are four color images of a first print job and at least one second printing cylinder includes four printing units each including a second plate cylinder and a second blanket cylinder and the images printed on the web with the second printing cylinders are four color images of a second print job.

7. The method recited in claim 1 further comprising:

adjusting the phasing of the at least one second printing cylinder with respect to the web again after the surface velocity of the at least one second printing cylinder equals the velocity of the web and before moving the at least one second printing cylinder towards the web.

8. The method recited in claim 7 wherein the step of adjusting the phasing of the at least one second printing cylinder with respect to the web again includes rotating the at least one second printing cylinder so that the phasing of the at least one second printing cylinder with respect to the web corresponds to a phasing of the at least one first printing cylinder with respect to the web.

* * * * *